US006033058A

United States Patent [19]

Usui et al.

[11] Patent Number: 6,033,058

[45] **Date of Patent: *Mar. 7, 2000**

[54] ACTUATOR FOR AN INK JET PRINT HEAD OF THE LAYERED TYPE WITH OFFSET LINEAR ARRAYS OF PRESSURE GENERATING CHAMBER

[75] Inventors: Minoru Usui; Takahiro Katakura, both of Nagano, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/671,556

[22] Filed: Jun. 27, 1996

[30] Foreign Application Priority Data

Jun. 27, 1995 [JP] Japan ..... 7-184851
Jun. 26, 1996 [JP] Japan ..... 8-185470

[51] Int. Cl.[7] ..... B41J 2/045

[52] U.S. Cl. ..... 347/71; 347/70; 347/43

[58] Field of Search ..... 347/40, 43, 68–72

[56] References Cited

U.S. PATENT DOCUMENTS 5,252,994 10/1993 Narita et al. ..... 347/71

FOREIGN PATENT DOCUMENTS

| | | | |
|---|---|---|---|
| 013095 | 7/1980 | European Pat. Off. | 347/40 |
| 0554907 | 8/1993 | European Pat. Off. | B41J 2/15 |
| 0584823 | 3/1994 | European Pat. Off. | B41J 2/16 |
| 0600743 | 6/1994 | European Pat. Off. | B41J 2/045 |
| 6119367 | 1/1986 | Japan | 347/40 |
| 375153 | 3/1991 | Japan | 347/71 |
| 6-40035 | 2/1994 | Japan | B41J 2/045 |
| 6-226975 | 8/1994 | Japan | B41J 2/045 |
| 9429110 | 12/1994 | WIPO | 347/40 |

*Primary Examiner*—John Barlow
*Assistant Examiner*—C. Dickens
*Attorney, Agent, or Firm*—Sughrue, Mion, Zinn, Macpeak & Seas, PLLC

[57] ABSTRACT

An actuator unit for an ink jet print head in which pressure generating chambers 30 and 31 are arranged in two linear arrays with a pitch P1 between the chambers in each linear array. The pressure generating chambers in one linear array are shifted by an amount equal to ¼ of P1 with respect to the pressure generating chambers in the other linear array. A plurality of actuator units may be connected to a single flow path unit of the ink jet print head, and the nozzle openings in one actuator unit may be shifted by ½ of P1 with respect to the nozzle openings in another actuator unit, or they may be aligned. Various arrangements of the nozzle openings, the pressure generating chambers, and the actuator units can be employed to vary the resolution and to print different colors.

26 Claims, 12 Drawing Sheets

ACTUATOR FOR AN INK JET PRINT HEAD OF THE LAYERED TYPE WITH OFFSET LINEAR ARRAYS OF PRESSURE GENERATING CHAMBER

BACKGROUND OF THE INVENTION

1. Field of the Invention

The present invention is directed to an actuator for an ink jet print head of the layered type which includes an actuator unit and a fluid path unit that are coupled together.

2. Description of the Related Art

In the ink jet print head disclosed in Published Unexamined Japanese Patent Application No. Hei. 6-40035, a piezoelectric vibrating plate is bonded to a portion of an elastic plate which forms a pressure generating chamber, and flexure displacement of the vibrating plate changes the volume of the pressure generating chamber to cause the chamber to expel an ink droplet. The pressure displacement may occur over a relatively large area of the pressure generating chamber, and therefore the print head of this type is capable of stably jetting ink droplets.

High resolution (e.g., 720 dpi or higher) is required for both monochromatic and color printing by an ink jet printer. However, in a print head which utilizes piezoelectric vibrating elements to cause flexure displacement, the width of the vibrating elements limits a further reduction of the minimum pitch of the nozzle openings of each nozzle opening linear array.

One solution to this problem is to shift the nozzle openings of nozzle opening arrays by a preset number of dots vertically, i.e., in the direction in which the nozzle openings are arrayed.

As shown in FIG. 12, in the construction of this type of print head, actuator units A, B and C, each of which consists of a pressure generating chamber, a vibrating plate and a piezoelectric vibrating plate coupled together by sintering, are mounted on a single fluid-path unit D of a metal plate having a plurality of nozzle opening linear arrays.

One problem in the print head described above is that it is necessary to manufacture plural actuator units having ink discharging ports formed at positions corresponding to respective ones of the nozzle openings in the fluid path unit. Accordingly, increased labor and time are required for manufacturing and managing those component parts of the print head.

SUMMARY OF THE INVENTION

An object of the present invention is to provide an actuator for an ink jet print head of the layered type, which can be used for a variety of nozzle opening arrangements.

The actuator of the instant invention includes an actuator unit having a first cover plate, a spacer with a plurality of cut out portions, and a second cover plate. The first cover plate, the spacer and the second cover plate may be made from a ceramic material and coupled together by sintering. A plurality of pressure generating chambers are defined by the cut out portions in the spacer which are closed by the first and second cover plates. The second cover plate has communicating holes for supplying ink from a common ink chamber of the flow path unit to the pressure generating chambers and ink discharging holes for discharging ink to the nozzles in the flow path unit. Drive electrodes are formed on the first cover plate, and piezoelectric vibrating plates are formed on the drive electrodes. The pressure generating chambers are disposed in two linear arrays with a pitch P1 between the adjacent pressure generating chambers in each array. The pressure generating chambers in one of the arrays are shifted in the direction of the array by an amount equal to P1/4 with respect to the pressure generating chambers in the other linear array of the same actuator unit.

BRIEF DESCRIPTION OF THE DRAWING FIGURES

Figure 3A:
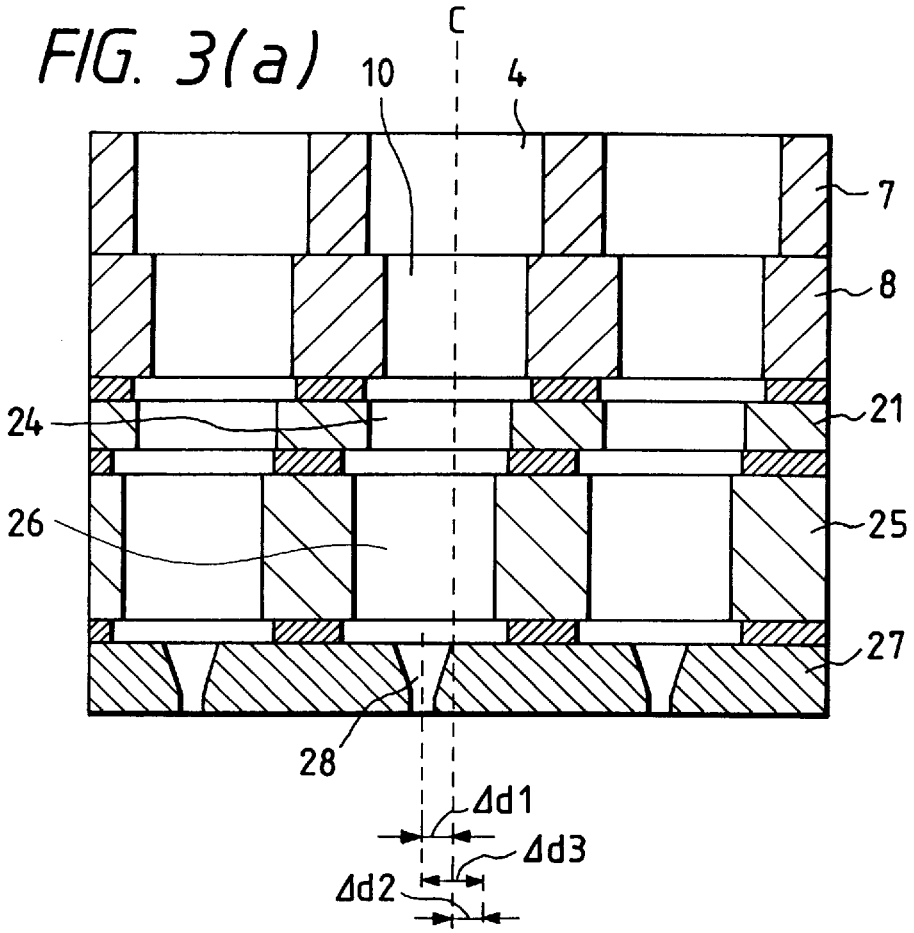
Figure 3B:
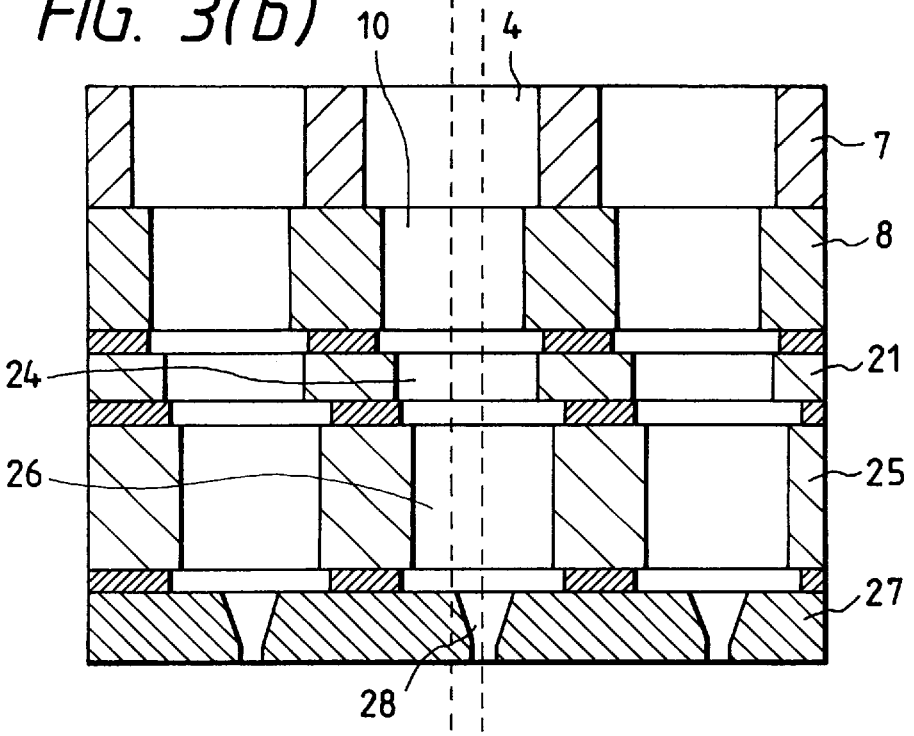

FIGS. 3(*a*) and 3(*b*) are sectional views showing a connection structure of the nozzle openings of a nozzle plate and the ink discharging ports of an actuator unit.

Figure 4:
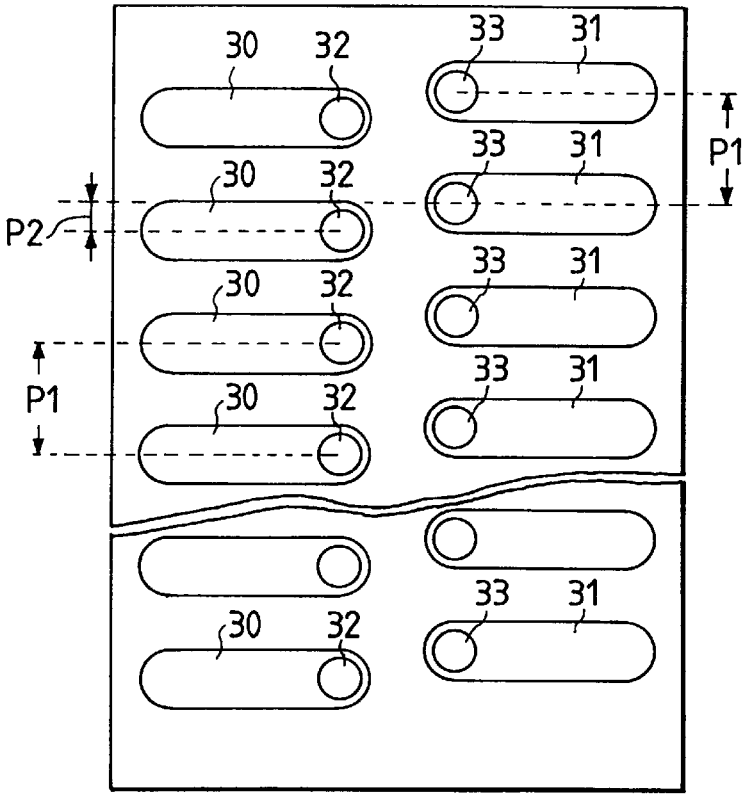

FIG. 4 is a plan view of the pressure generating chambers of an actuator unit and ink discharging ports communicatively coupled with the pressure generating chambers.

Figure 5:
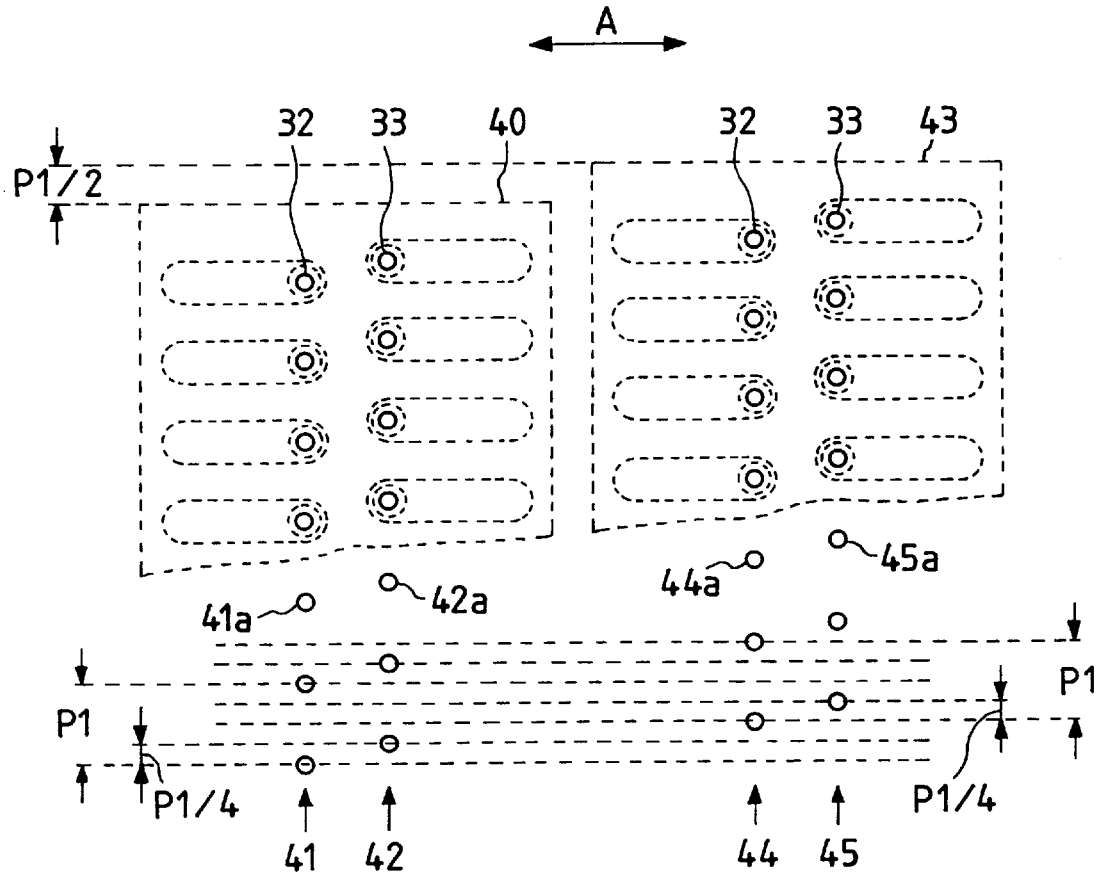

FIG. 5 is a diagram showing the arrangement of nozzle openings and actuator units in a print head for high resolution monochromatic printing.

Figure 6:
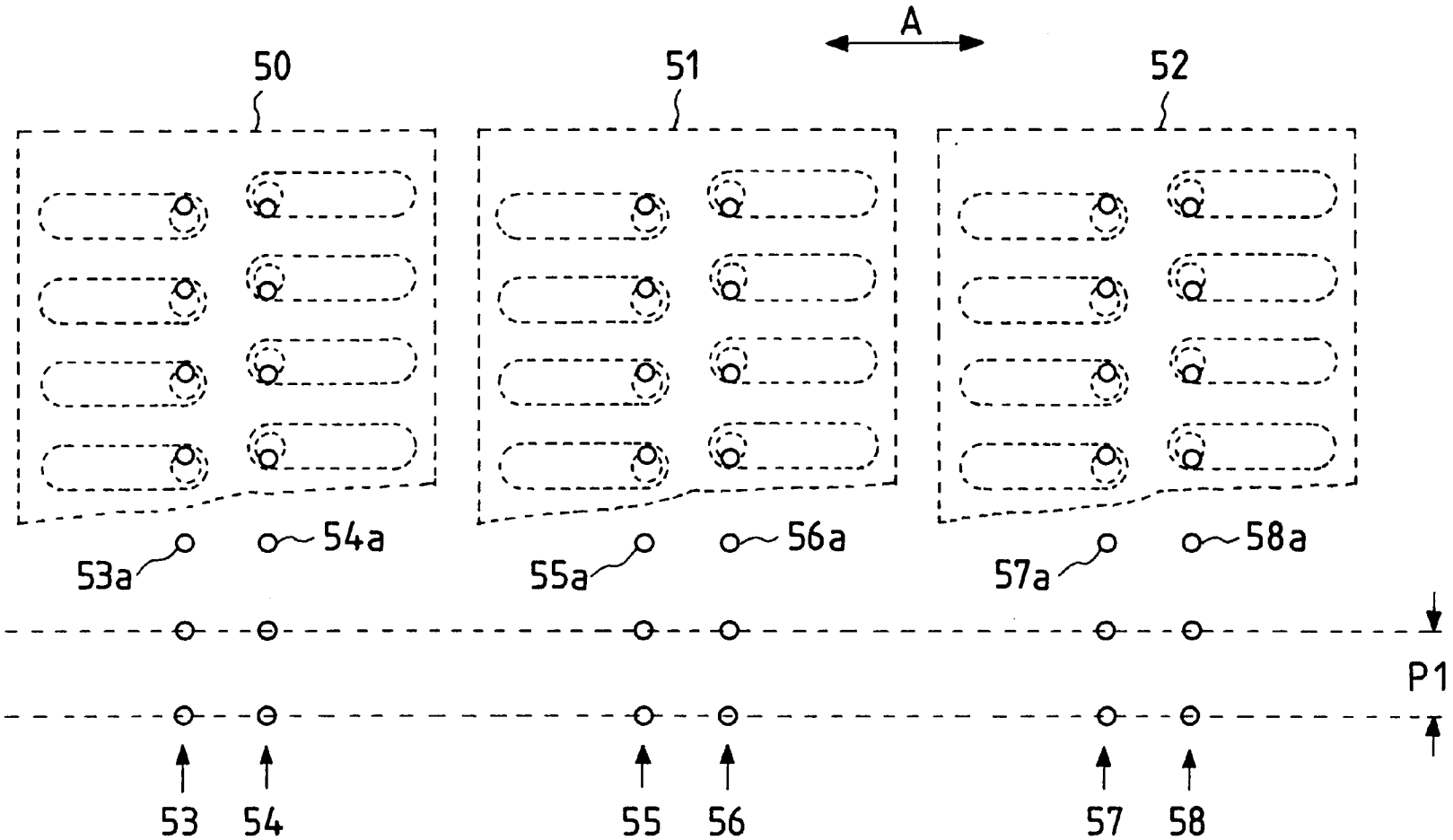

FIG. 6 is a diagram showing the arrangement of nozzle openings and actuator units in a color print head in which each pair of nozzle opening linear arrays discharge ink of a different color including dark and light shades.

Figure 7:
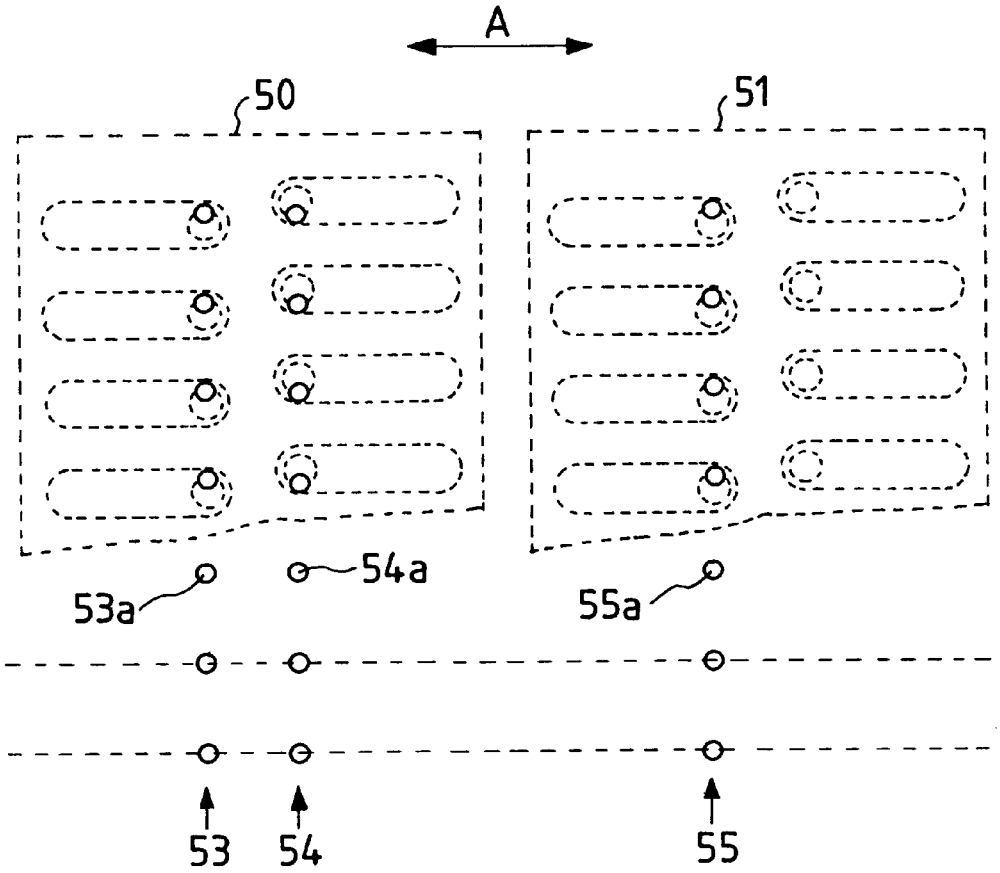

FIG. 7 is a diagram showing the arrangement of nozzle openings and actuator units in a color print head for jetting three colors, each nozzle opening linear array discharging ink of a different color.

Figure 8:
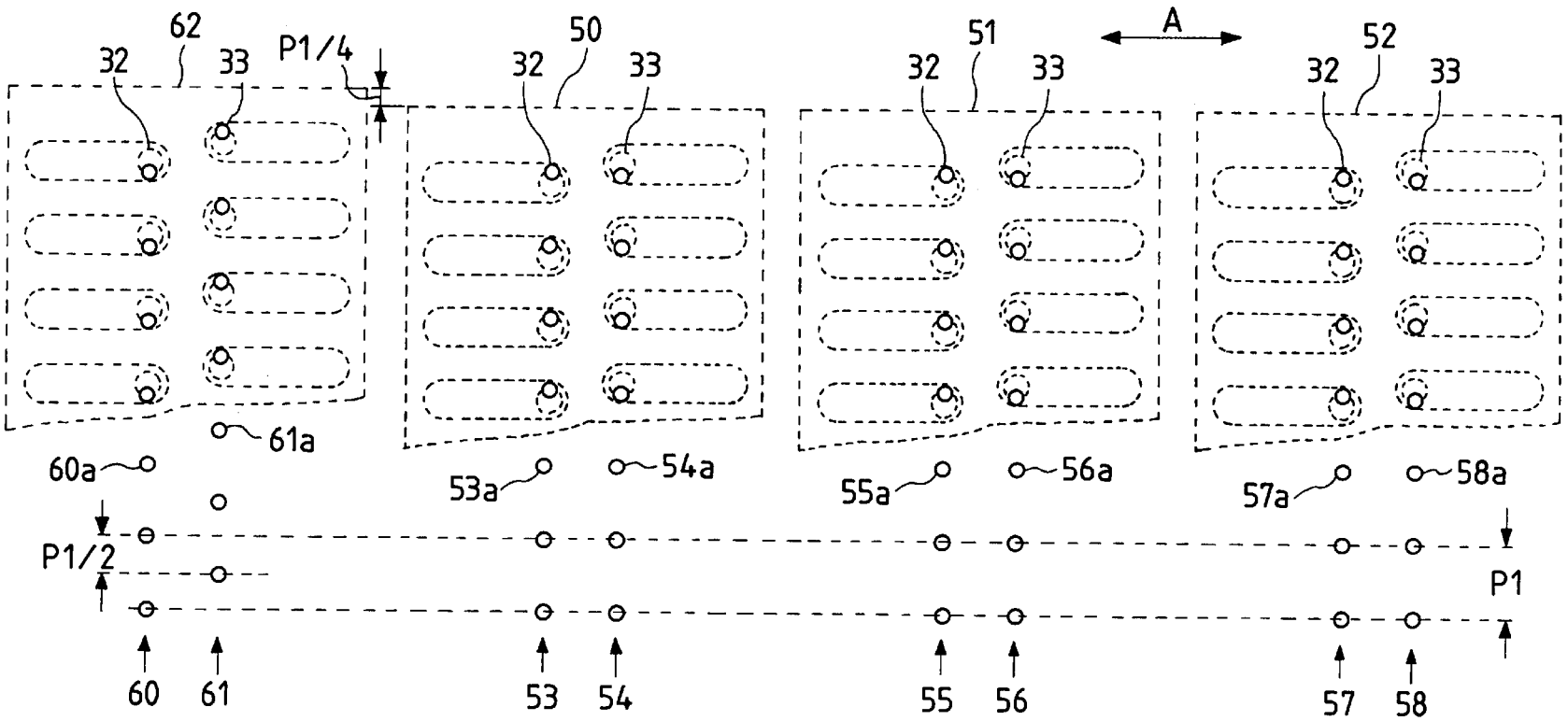

FIG. 8 is a diagram showing the arrangement of nozzle openings and actuator units in a print head for monochromatic printing and color printing of six colors by using ink of three different colors, each color consisting of dark and light shades, and black ink.

Figure 9:
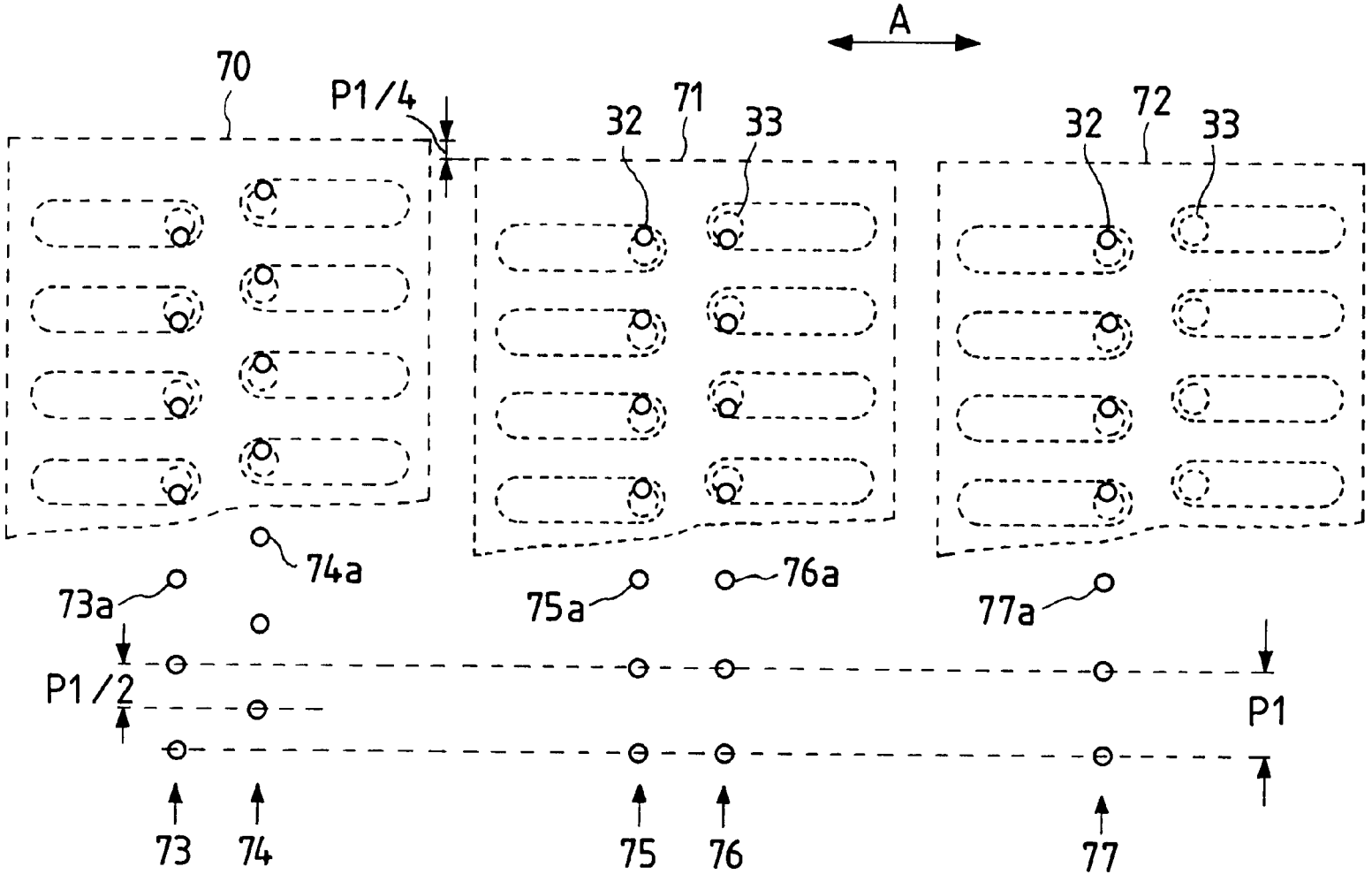

FIG. 9 is a diagram showing the arrangement of nozzle openings and actuator units in a print head for monochromatic printing and color printing of by using ink of three different colors, and black ink.

Figure 10:
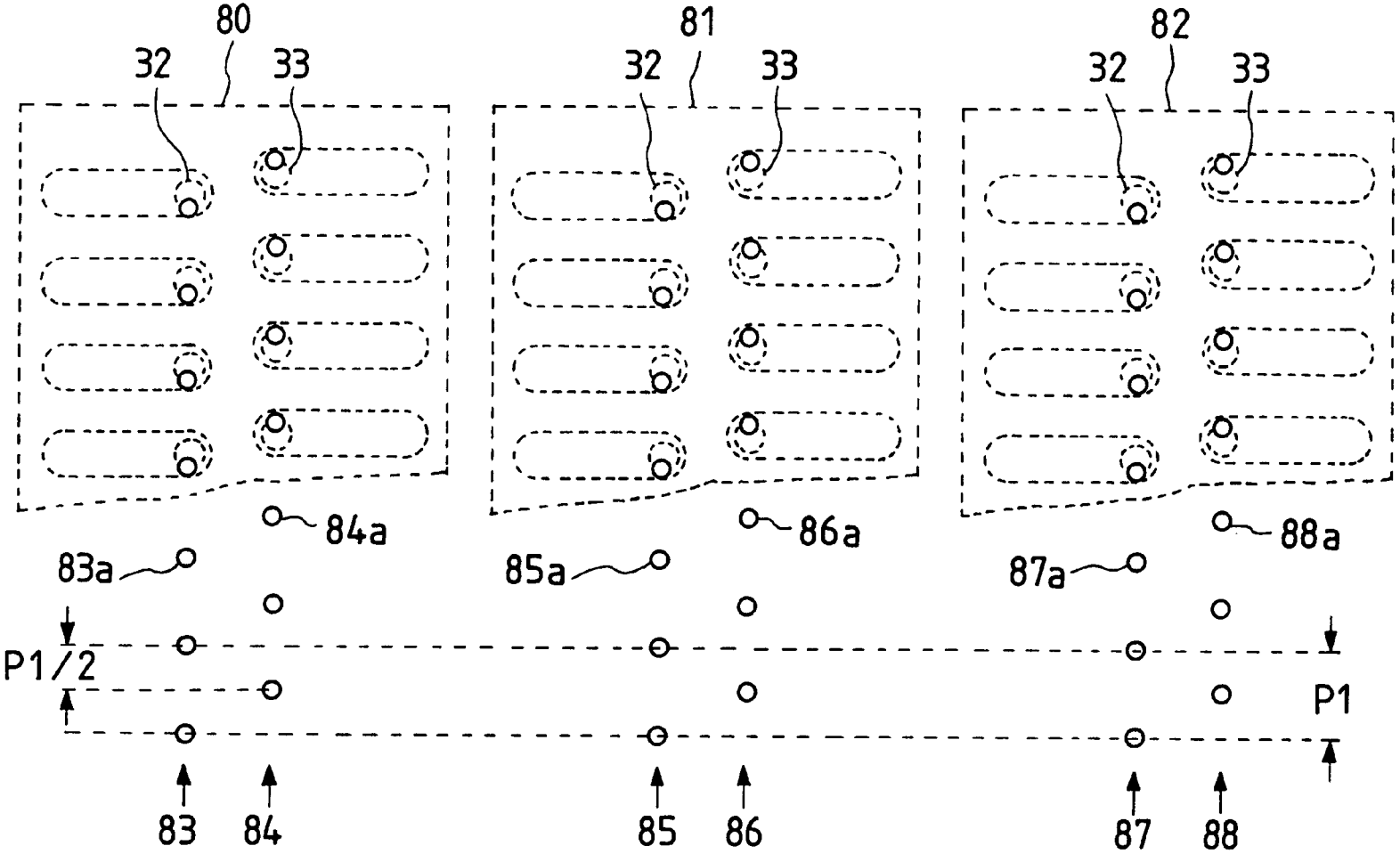

FIG. 10 is a diagram showing the arrangement of nozzle openings and actuator units in a print head for color printing at high resolution by using ink of three different colors.

Figure 11:
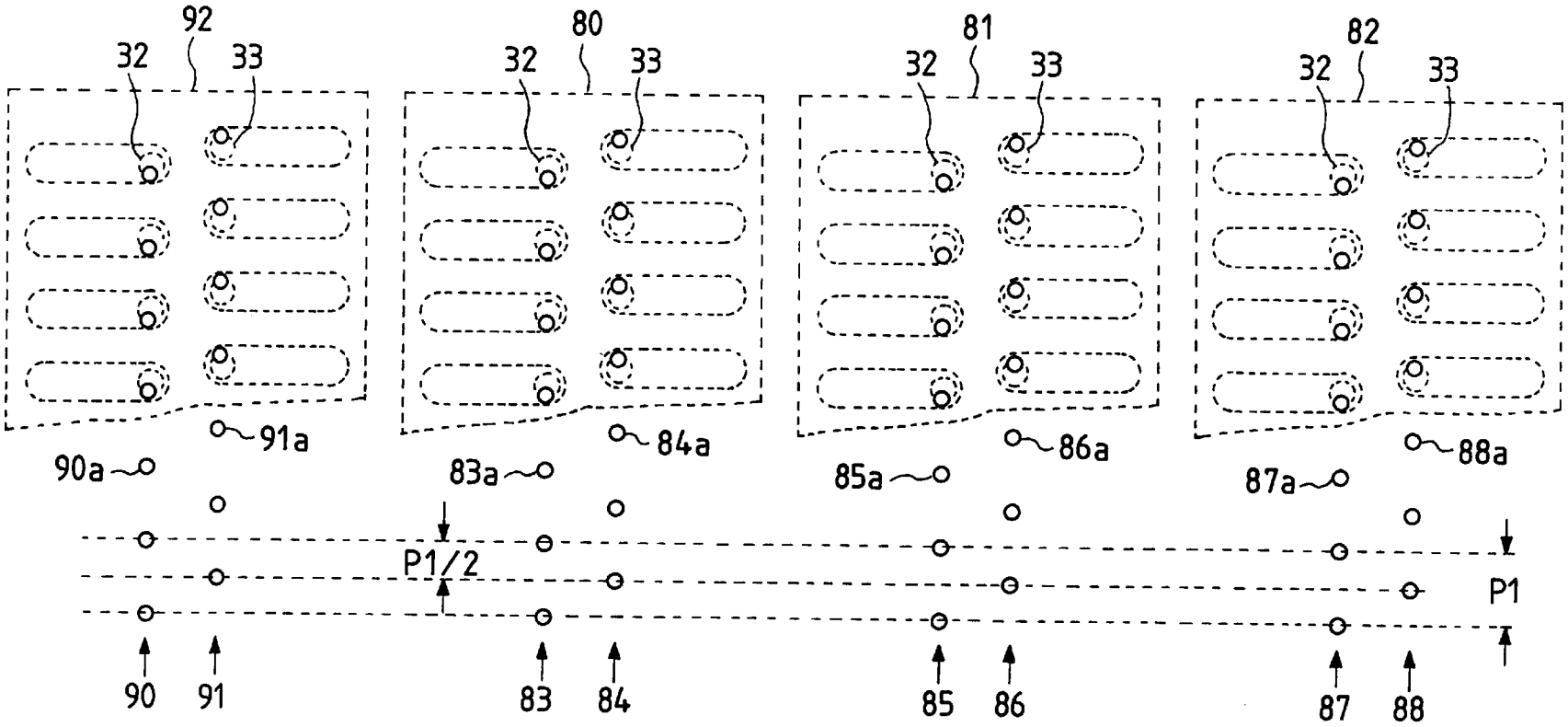

FIG. 11 is a diagram showing the arrangement of nozzle openings and actuator units in a print head capable of performing monochromatic printing and color printing by using ink of three different colors, and black ink.

Figure 12:
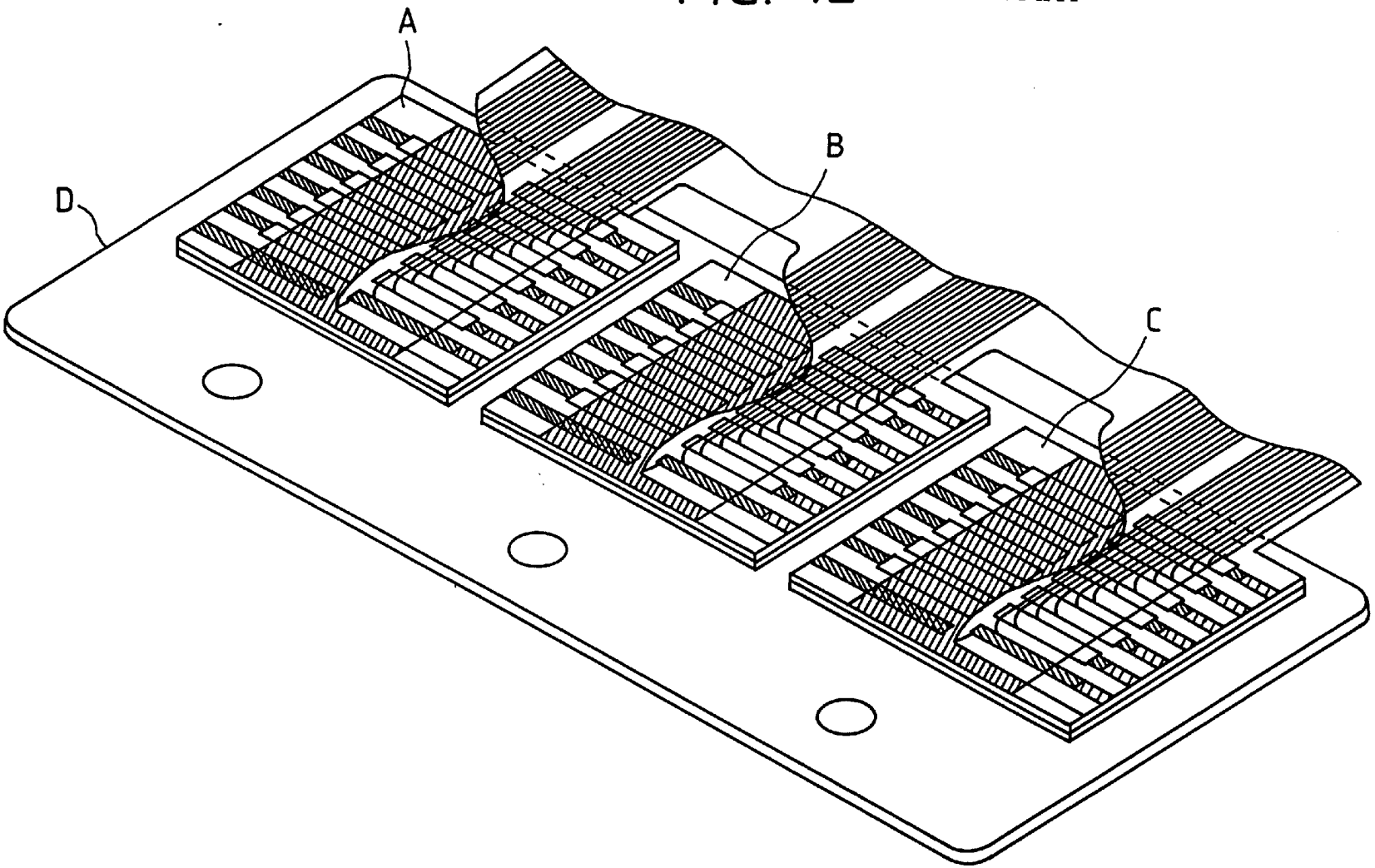
FIG. 12 PRIOR ART

FIG. 12 is a diagram showing a conventional ink jet print head of the layered type.

Figure 13:
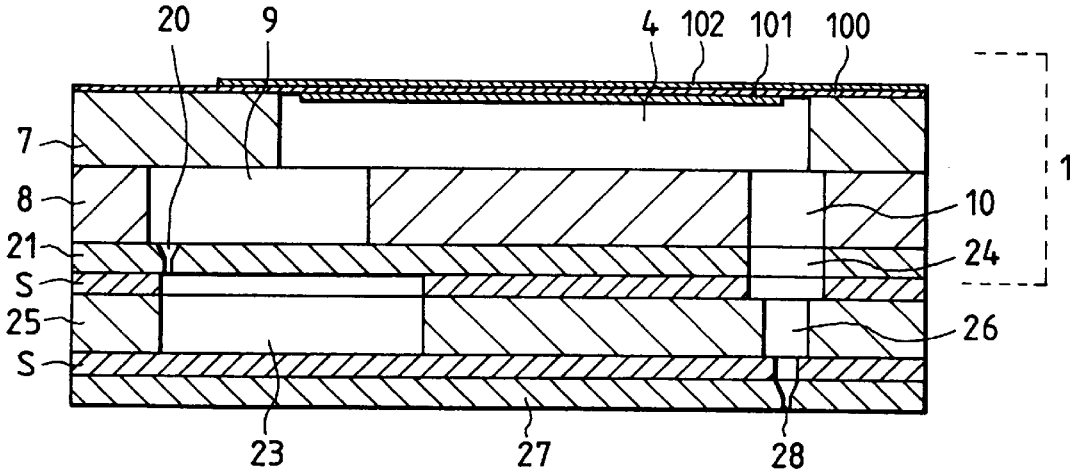

FIG. 13 is a cross sectional view showing pressure generating chambers and their related portions in one actuator unit in another ink jet print head of the invention.

Figure 14:
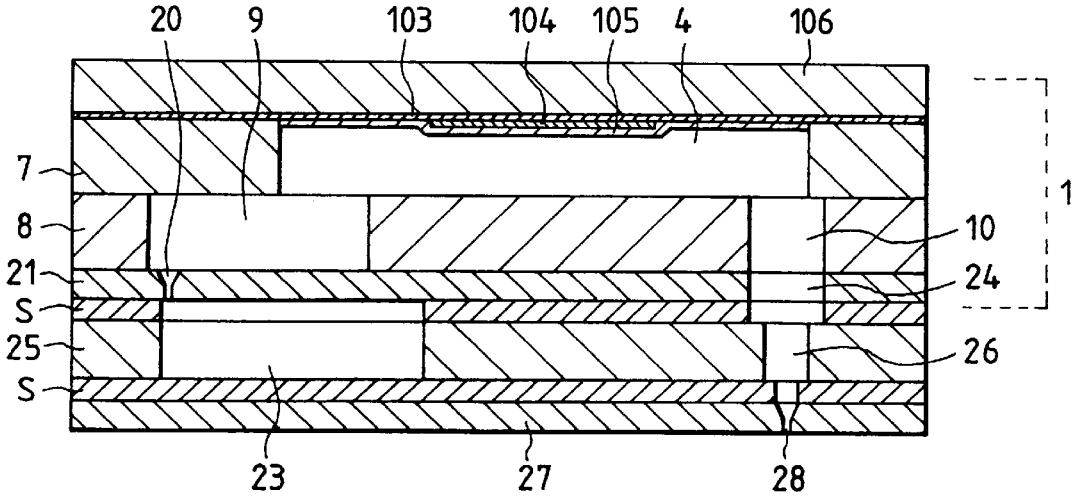

FIG. 14 is a cross sectional view showing pressure generating chambers and their related portions in one actuator unit in still further ink jet print head of the invention.

DETAILED DESCRIPTION OF THE PREFERRED EMBODIMENTS

The preferred embodiments of the present invention will be described with reference to the accompanying drawings.

Figure 1:
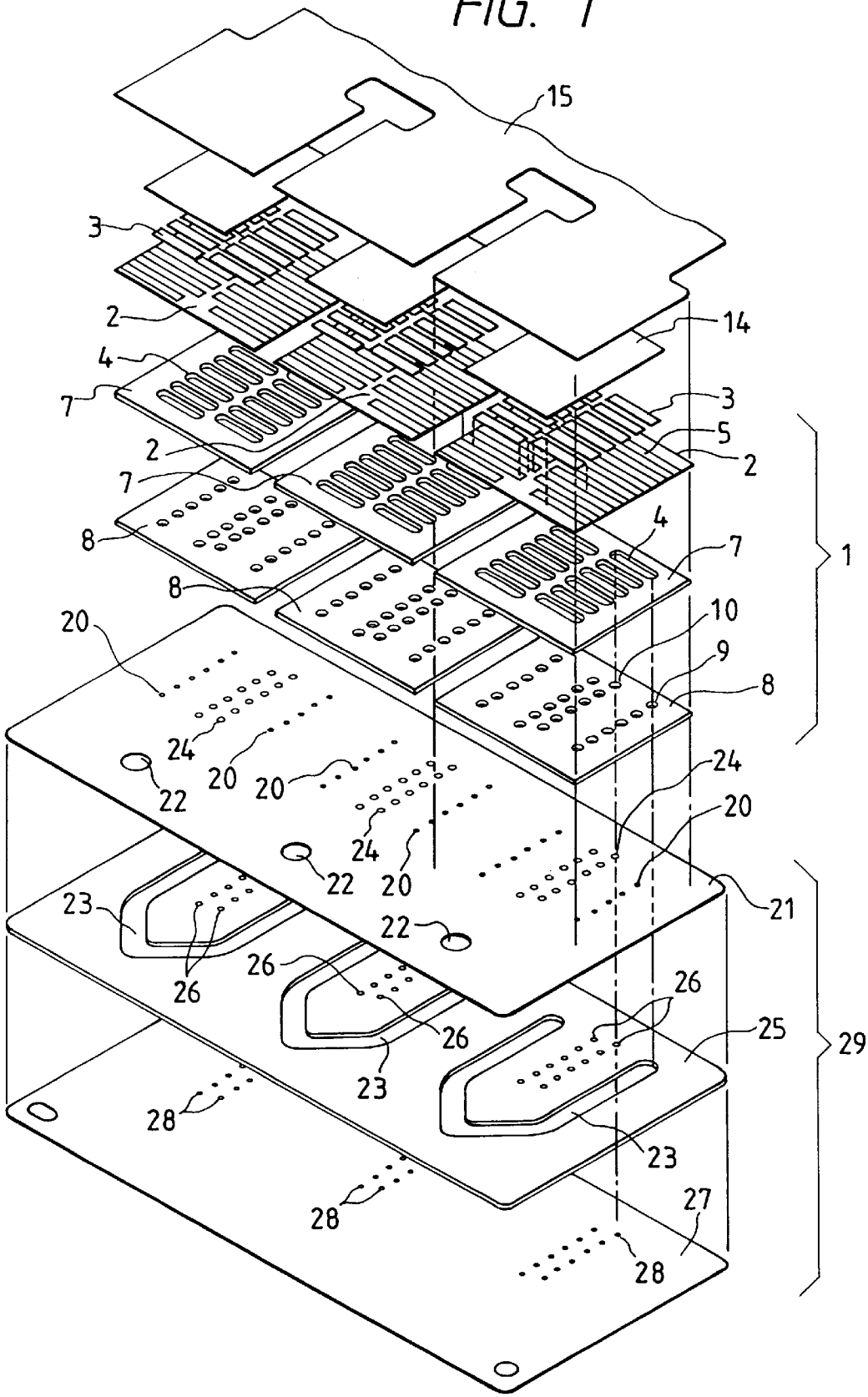
FIG. 1 is an exploded perspective view of an ink jet print head using an actuator according to an embodiment of the present invention.
Figure 2:
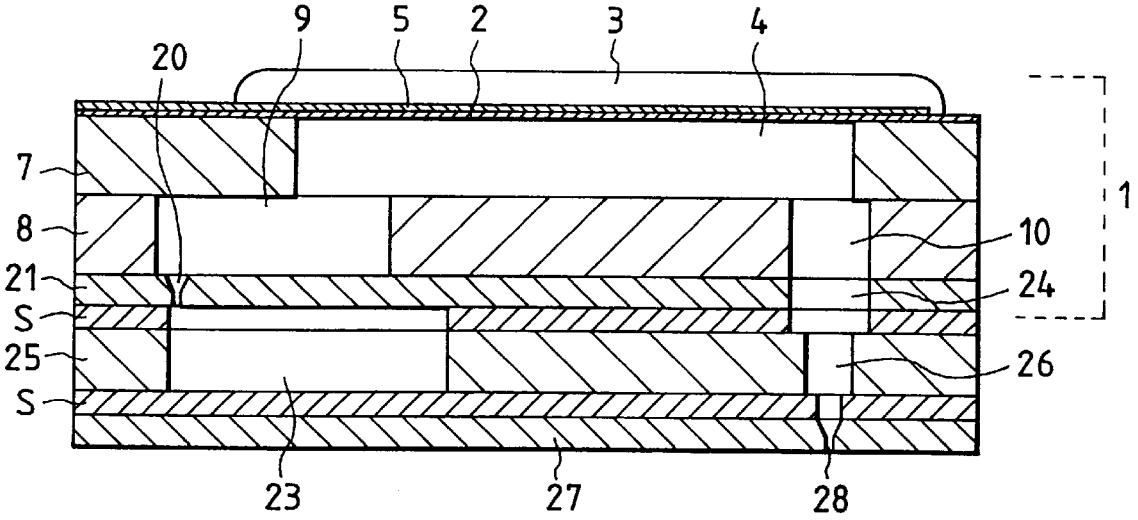
FIG. 2 is a cross sectional view showing the pressure generating chambers and their related portions in one actuator unit in the ink jet print head of the invention.

FIG. 1 is an exploded perspective view of a print head using an actuator according to an embodiment of the present invention. FIG. 2 is a cross sectional view of the pressure generating chambers and their related portions in one actuator unit 1 of an ink jet head of the invention. In these figures, first cover plates 2 each include a zirconia thin plate approximately 10 μm thick. Drive electrodes 5 are formed on the first cover plate 2 such that the drive electrodes face pressure generating chambers 4 (described below). Piezoelectric vibrating plates 3 made of PZT, for example, are formed on the drive electrodes 5. The pressure generating chambers 4 receive a deflection vibration of the piezoelectric vibrating plate 3 so as to be compressed and expanded in volume. Through the compressing/expanding operations, the pressure generating chamber 4 jets an ink droplet through a nozzle opening 28, and sucks ink from a common ink chamber 23 through an ink supply port 20.

Each spacer 7 may be made of a ceramic plate with through holes properly arrayed. For example, the spacer may be made of zirconia ($ZrO_2$) and have a thickness of 150 μm, which is suitable for forming the pressure generating chambers 4. The spacer 7 is sandwiched between a second cover plate 8 (described below) and the first cover plate 2 so as to form the pressure generating chambers 4.

Each second cover plate 8 is a ceramic plate made of zirconia, for example, and has communicating holes 9 formed therein for communicating the ink supply ports 20 (described below) with the pressure generating chambers 4. Each second cover plate 8 also has ink discharging ports 10 formed therein for discharging ink to the nozzle openings 28. The second cover plate 8 is firmly attached to the underside of the spacer 7.

The first and second cover plates 2, 8, respectively, and the spacer 7 may be coupled together into the actuator unit 1, without using any adhesive. For example, a clayish ceramic material can be molded into three layers of a predetermined shape and thickness, and these layers can be put together and sintered.

An ink supply port forming substrate 21 also serves as a fixing substrate for the actuator unit 1. The ink supply port forming substrate 21 is made of ceramic or metal of an anti-ink nature, for example, stainless steel, and therefore allows a connection member to the ink tank to be mounted thereon.

Ink supply ports 20, which connect the common ink chamber 23 to the pressure generating chambers 4, are formed in the ink supply port forming substrate 21 close to one end of the pressure generating chamber 4. The ink supply ports 20 include a cone shaped portion adjacent to the second cover plate 8 (see FIG. 2). Communicating holes 24, which are provided for connecting the nozzle opening 28 to the ink discharging ports 10 of the actuator unit 1, are each formed close to the opposite end of the pressure generating chamber 4. Ink inlet ports 22 for receiving ink from an ink tank (not shown), are formed at positions outside of the area of the surface of the ink supply port forming substrate 21 on which the actuator unit 1 is to be mounted.

A common ink chamber forming substrate 25 is formed of a plate like member made of a material of an anti-corrosion nature, for example, stainless steel, and having a thickness, for example, of 150 μm, which is suitable for forming the common ink chambers 23 therein. Through holes each having a configuration of the common ink chamber 23, and communicating holes 26, linearly arrayed, for connecting the nozzle openings 28 of a nozzle plate 27 to the ink discharging ports 10, are formed in the plate like member.

As shown in FIGS. 3(*a*) and 3(*b*), the communicating holes 24 and 26 absorb a misalignment of Δd1 or Δd2 of the nozzle openings 28 of the nozzle plate 27 with the ink discharging ports 10 of the actuator unit 1, and smoothly guide ink from the pressure generating chambers 4 to the nozzle openings 28. Provision of these holes allows each nozzle opening 28 to be shifted Δd3 with respect to the center line C of the pressure generating chamber 4 in the alignment direction of the pressure generating chambers 4.

Nozzle opening series 28 formed in the nozzle plate 27 are arrayed according to the type of printing, e.g., high resolution monochromatic printing or multi-color printing. The nozzle openings are linearly arrayed in two series for each of the actuator units 1.

The ink supply port forming substrate 21, the common ink chamber forming substrate 25, and the nozzle plate 27 are coupled together to form a fluid path unit 29. Adhesive layers S, made of hot-melt films or adhesive, are interlayered between the adjacent substrates or plates.

A plurality of actuator units 1 with the same or similar construction are bonded onto the surface of the ink supply port forming substrate 21 of the fluid path unit 29, to thereby form a complete print head for color printing or high resolution monochromatic printing.

Common electrodes 14 are formed on the piezoelectric vibrating plates 3, and flexible cables 15 are connected to an external device.

FIG. 4 is a plan view of a specific example of the actuator unit 1. In this figure, reference numerals 30, 30, 30, etc. designate first pressure generating chambers, and reference numerals 31, 31, 31, etc. designate second pressure generating chambers. First ink discharging ports 32, 32, 32, etc. and second ink discharging ports 33, 33, 33, etc. are linearly arrayed on both sides of, and parallel to, the center line between the vertical arrays of the first and second pressure generating chambers. The first and second ink discharging ports are formed at fixed positions relative to the pressure generating chambers.

The first ink discharging ports 32, 32, 32, etc. and the second ink discharging ports 33, 33, 33, etc. are arrayed at pitches P1 for draft printing, e.g., 1/90 inch (approximately 0.282 mm).

The first ink discharging ports 32, 32, 32, etc. are vertically shifted from the second ink discharging ports 33, 33, 33, etc. by a distance P2, e.g., 1/360 inch (approximately 0.070 mm). The distance P2 is selected such that the closest discharging ports complement the pitches thereof to realize high resolution printing. In other words, the first and second ink discharging ports are linearly arrayed such that the closest ones are vertically shifted ¼ of the pitch P1 of the linearly arrayed ink discharging ports 32 and 33, i.e., P2=P1/4.

Thus, the first and second ink discharging ports are linearly arrayed such that the closest ones are vertically shifted by a pitch P2, which is ¼ of the pitch P1 of the ink discharging ports 32 and 33 and which is suitable for draft printing. Accordingly, the communicating holes 24 and 26 of the ink supply port forming substrate 21 and the common ink chamber forming substrate 25, respectively, both forming part of the fluid path unit 29, are shifted slightly, e.g., 1/360 inch, in the direction in which the nozzle openings are arrayed. Hence, the nozzle openings may be vertically shifted P1/2 at maximum (see FIG. 3), i.e., P2=P1/4 and 2P2=P1/2. Consequently, a single actuator unit 1 can be used for a variety of arrangements of the nozzle openings 28.

FIGS. 5 through 11 show ink jet print heads incorporating the thus constructed actuator units 1, which have different arrangements of the nozzle openings and the actuator units.

FIG. 5 shows a print head for monochromatic printing, which uses two of the above-mentioned actuator units of the same construction, and is capable of printing at the pitch P2, equal to ¼ of the pitch P1 of the ink discharging ports 32 and 33, linearly arrayed.

In a first actuator unit 40, nozzle openings 41*a*, 41*a*, 41*a*, etc., form one linear array 41, and similarly nozzle openings 42*a*, 42*a*, 42*a*, etc. form another linear array 42. Also in a second actuator unit 43, nozzle openings 44*a*, 44*a*, 44*a*, etc., and 45*a*, 45*a*, 45*a*, etc. form respective linear arrays 44 and 45. The pitch of the nozzle openings 41*a*, 42*a*, 44*a* and 45*a* is the same as the pitch P1 of the ink discharging ports 32 and 33 of the first and second actuator units 40 and 43.

The closest nozzle openings 41*a* and 42*a* of the paired linear arrays 41 and 42 are vertically shifted a distance P2 that is equal to ¼ of the pitch P1 of the ink discharging ports 32 and 33. Similarly, the closest nozzle openings 44*a* and 45*a* of the paired linear arrays 44 and 45 are vertically shifted by the same distance, P1/4. Further, the nozzle openings 41*a* and 42*a* of the first actuator unit 40 are vertically shifted from the nozzle openings 44*a* and 45*a* of the second actuator unit 43 by a distance equal to ½ of the pitch P1 of the ink discharging ports 32 and 33.

The actuator units of the invention are applicable for the nozzle openings thus arranged, by vertically shifting the units 40 and 43 by a distance, equal to ½ of the pitch P1 of the ink discharging ports 32 and 33. The resultant print head is capable of performing monochromatic printing at a resolution of P1/4.

FIG. 6 shows a six color print head using three actuator units 50, 51 and 52. In this print head, the actuator units are respectively assigned to three different colors, each color consisting of dark and light shades.

In paired nozzle opening linear arrays 53 and 54, 55 and 56, and 57 and 58, the nozzle openings are linearly arrayed at a pitch equal to the pitch P1 of the ink discharging ports 32 and 33 of the actuator units 50, 51 and 52. The nozzle openings are horizontally aligned with each other in the carriage moving direction (identified by the arrow "A" in the drawing figure).

The ink discharging ports 32 are shifted from the ink discharging ports 33 by a distance equal to ¼ of the pitch P1 of the ports 32 and 33 in the nozzle opening arraying direction, with respect to the centers of the nozzle openings 53*a* to 58*a* of the linear arrays 53 to 58.

In the above-mentioned embodiment, six nozzle opening linear arrays are used for discharging ink of six colors (i.e., three different colors each having two shades). Since the two nozzle opening liner arrays belonging to the same actuator unit discharge ink of two shades of the same color, similar discharging characteristics are obtained in the same color. Therefore, print images with high quality can be obtained. A modification is shown in FIG. 7. In this modification, only three nozzle opening linear arrays 53, 54 and 55 are formed as in the previous manner. Two actuator units 50 and 51 are employed. The nozzle openings of the linear arrays 53, 54 and 55 discharge ink of three different colors.

FIG. 8 shows another print head of the invention. The nozzle opening linear array 60 is horizontally aligned with the remaining paired nozzle opening linear arrays 53 and 54, 55 and 56, and 57 and 58 for color printing. In the actuator unit 62 including the paired nozzle opening linear arrays 60 and 61, the nozzle openings 60*a* of the linear array 60, respectively, are connected to the first ink discharging ports 32 while being in contact with the lower sides of the first ink discharging ports 32. The nozzle openings 61*a* of the nozzle opening linear array 61, respectively, are connected to the second ink discharging ports 33 while being in contact with the upper sides of the ink discharging ports 33. Accordingly, the nozzle openings 60*a*, 53*a*, 54*a*, 55*a*, 56*a*, 57*a* and 58*a* of the nozzle opening linear arrays 60, 53 to 58 are horizontally aligned with one another. The print head thus arranged is capable of performing monochromatic printing, as well as color printing of six colors by ink of three different colors and black ink. The monochromatic printing is performed at high resolution equal to ½ of the pitch of the linearly arrayed ink discharging ports 32 and 33.

FIG. 9 shows an additional print head of the present invention. The print head includes three actuator units 70, 71 and 72 having the same constructions, and it is capable of performing both monochromatic and color printing. Nozzle opening linear arrays 73 and 74 are for discharging black ink. The nozzle openings 73*a* and 74*a* of linear arrays 73 and 74, respectively, are linearly arrayed at the same pitch as the ink discharging ports 32 and 33 of an actuator unit 70. The nozzle openings 73*a* are vertically shifted from the nozzle openings 74*a* by ½ (P1/2) of the pitch P1 of the ink discharging ports 32 and 33. With this pitch, the print head is capable of performing high resolution printing.

The remaining nozzle opening linear arrays 75, 76 and 77 are for discharging color ink. The nozzle openings 75*a*, 76*a* and 77*a* of these linear arrays 75, 76 and 77, respectively, are horizontally aligned with the nozzle openings of one of the linear arrays 73 and 74 for monochromatic printing. In the embodiment in FIG. 9, they are aligned with the nozzle openings 73*a* of the linear array 73. The pitch of the nozzle openings 75*a*, 76*a* and 77*a* linearly arrayed is the same as the pitch P1 of the ink discharging ports 32 and 33 also linearly arrayed.

The nozzle openings 73*a* and 74*a* of the linear arrays 73 and 74 for monochromatic printing are connected to the ink discharging ports 32 and 33 such that the nozzle openings 73*a* are in contact with the lower sides of the ink discharging ports 32, and the nozzle openings 74*a* are in contact with the upper sides of the ink discharging ports 33.

For the nozzle opening linear arrays 75, 76 and 77, the actuator units 71 and 72 for color printing are vertically shifted from the actuator unit 70 for monochromatic printing by a distance of ¼ of the pitch P1 of the ink discharging ports 32 and 33. The nozzle openings 75*a* and 77*a* of the linear arrays 75 and 77 of the actuator units 71 and 72 are connected to the ink discharging ports 32 while being in contact with the upper sides of the ink discharging ports 32. The nozzle openings 76*a* of the linear array 76 are connected to the ink discharging ports 33 while being in contact with the lower sides of the ink discharging ports 33.

FIG. 10 shows a print head of the present invention including three actuator units 80, 81 and 82 having the same constructions. The print head is suitable for color printing at high resolution of ½ of the pitch P1 of the ink discharging ports 32 and 33. In the actuator unit 80, paired nozzle openings 83*a* and 84*a*, which are linearly arrayed into nozzle opening linear arrays 83 and 84, are vertically shifted from each other by ½ of the pitch P1 of the ink discharging ports 32 and 33. The same thing is true for the paired nozzle openings 85*a* and 86*a*, and 87*a* and 88*a* of the linear arrays 85 and 86, and 87 and 88 of the actuator units 81 and 82. The nozzle openings 83*a*, 85*a* and 87*a* of the linear arrays 83, 85 and 87 are horizontally aligned with one another, and the nozzle openings 84*a*, 86*a* and 88*a* of the linear arrays 84, 86 and 88 are also horizontally aligned with one another.

The actuator units 80, 81 and 82 are fixed such that the nozzle openings 83*a*, 85*a* and 87*a* of the linear arrays 83, 85 and 87 are connected to the ink discharging ports 32 associated therewith while those openings are in contact with the lower sides of the ink discharging ports 32, and such that the nozzle openings 84*a*, 86*a* and 88*a* of the linear arrays 84, 86 and 88 are connected to the ink discharging ports 33 associated therewith while those openings are in contact with the upper sides of the ink discharging ports 33.

FIG. 11 shows a further print head of the invention. This print head includes three actuator units 80, 81 and 82, and an additional actuator unit 92. All of the actuator units have the same construction. The additional actuator unit 92 also consists of a pair of nozzle opening linear arrays 90 and 91 respectively consisting of nozzle openings 90*a* and 91*a*.

In the print head, the nozzle openings 90*a*, 83*a*, 85*a*, and 87*a* of the linear arrays 90, 83, 85 and 87 are horizontally aligned with one another, and similarly the nozzle openings 91*a*, 84*a*, 86*a*, and 88*a* of the linear arrays 91, 84, 86 and 88 are horizontally aligned with one another. The nozzle openings 90*a* and 91*a* of the paired linear arrays 90 and 91 are vertically shifted from each other by ½ of the pitch of the ink discharging ports 32 and 33 linearly arrayed. The same thing is correspondingly applied to the nozzle openings linearly arrayed in the remaining actuator units 80–82. Accordingly, the present print head is also capable of performing both monochromatic and color printing at high resolution.

In the aforementioned actuator unit, the pressure generating portion comprises the first cover plates 2, the piezoelectric vibrating plates 3 and the drive electrodes 5 as shown in FIG. 2. Alternatively, the pressure generating portion which comprises piezoelectric vibrating plates 100, lower electrodes 101 and upper electrodes 102 so as to seal a surface of the space may be applied as shown in FIG. 13. Furthermore, the pressure generating portion comprising cover plates 106, electrically conductive layer 103, heating elements 104 and protective layer 105 may be used as shown in FIG. 14. Other constitutions which makes the pressure in the pressure generating chamber change may be used for the present invention.

As seen from the foregoing description, in the print head of the instant invention, pressure generating chambers are linearly arrayed at a pitch P1 in two linear arrays such that in the two linear arrays, two pressure generating chambers, which are closest to each other, are vertically shifted ¼ of the pitch P1 of the pressure generating chambers in each linear array. Accordingly, the pressure generating chambers, located at the center thereof, communicate with the nozzle openings that are arranged for high resolution with narrower gap lengths. Further, the pressure generating chambers, located near the outer end thereof, communicate with the nozzle openings of different linear arrays that are arrayed on lines parallel to each other in the moving direction of the carriage, and the nozzle openings of one of the linear arrays are vertically shifted from those of the other by ½ of the pitch of the nozzle openings of those linear arrays. Thus, the actuator unit of the invention is applicable for a variety of nozzle opening arrangements. Accordingly, the manufacturing process is simplified, the reliability of the product is improved, and the cost of manufacturing is reduced. Further, the actuators manufactured according to the invention have uniform performance, and hence print images with high quality can be obtained.

What is claimed is:

1. An actuator unit for an ink jet print head, the ink jet print head having a plurality of nozzles for jetting ink, said actuator unit comprising:

a plurality of pressure generating chambers communicating respectively with the nozzles; and pressure generating means for pressurizing respectively said plurality of pressure generating chambers, wherein said pressure generating chambers are disposed in two linear arrays each having a pitch P1 between adjacent pressure generating chambers, and wherein said pressure generating chambers in one of the linear arrays are shifted by an amount equal to P1/4 with respect to said pressure generating chambers in the other one of the linear arrays.

2. The actuator unit according to claim 1, wherein said pitch P1 between said pressure generating chambers in each linear array is approximately 1/90th of an inch.

3. The actuator unit according to claim 1, further comprising:

a first cover plate having an upper major surface and a lower major surface;

drive electrodes formed on said upper major surface of said first cover plate;

piezoelectric vibrating plates formed on said drive electrodes; and a spacer having an upper major surface and a lower major surface and a plurality of openings, said upper major surface of said spacer being secured to said lower major surface of said first cover plate, wherein said plurality of pressure generating chambers are defined by said openings in said spacer which are closed by said first cover plate.

4. The actuator unit according to claim 3, further comprising a second cover plate which includes:

an upper major surface being secured to said lower major surface of said spacer;

a lower major surface;

a plurality of communicating holes through which ink is supplied to said pressure generating chambers; and a plurality of ink discharging ports for discharging ink from said pressure generating chambers.

5. The actuator unit according to claim 3 or 4, wherein said first cover plate, said spacer and said second cover plate are made of a ceramic material and bonded together by sintering.

6. An actuator unit as recited in claim 1, wherein said pressure generating chambers are disposed in a single plane.

7. An ink jet print head comprising:

an actuator unit; and a fluid path unit which is fluidly communicated with said actuator unit and has a plurality of nozzles for jetting ink, said actuator unit comprising:

a plurality of pressure generating chambers communicating respectively with the nozzles for jetting ink droplets, and pressure generating means for pressurizing respectively said plurality of pressure generating chambers, wherein the pressure generating chambers are disposed in two linear arrays each having a pitch P1 between adjacent pressure generating chambers, and wherein said pressure generating chambers in one of the linear arrays are shifted by an amount equal to P1/4 with respect to said pressure generating chambers in the other one of the linear arrays.

8. The inkjet print head according to claim 7, wherein, for one of said two linear arrays of pressure generating chambers, the nozzles are offset with respect to said pressure generating chambers by a predetermined amount in a first direction along said one linear array.

9. The inkjet print head according to claim 8, wherein, for the other of said two linear arrays of pressure generating chambers, the nozzles are offset with respect to said pressure generating chambers by the predetermined amount in a second direction along said one linear array, said second direction being opposite from said first direction.

10. The ink jet print head according to claim 9, wherein the nozzles are aligned in a third direction which is transverse to said first direction and said second direction.

11. The ink jet print head according to claim 7, comprising a plurality of actuator units.

12. The ink jet print head according to claim 7, comprising a plurality of separate actuator units connected to said fluid path unit, said fluid path unit being a single fluid path unit.

13. The ink jet print head according to claim 11 or 12, wherein one actuator unit is offset with respect to an adjacent actuator unit by an amount equal to P1/2.

14. The ink jet print head according to claim 11 or 12, wherein one actuator unit is offset with respect to the other actuator units by an amount equal to P1/4.

15. The ink jet print head according to claim 7, 11 or 12, wherein at least one of said linear arrays of pressure generating chambers is not operative.

16. The ink jet print head according to claim 11 or 12, wherein the actuator units receive a different color inks.

17. The ink jet print head according to claim 16, wherein at least one of the different color ink has two or more shades.

18. The ink jet print head according to claim 11 or 12, wherein the nozzles corresponding to one linear array of pressure generating chambers in one of the actuator units are aligned with the nozzles corresponding to the other linear arrays of pressure generating chambers in other actuator units.

19. The ink jet print head according to claim 11 or 12, wherein the nozzles corresponding to one linear array of pressure generating chambers in each of said actuator units are aligned with each other in a direction transverse to said linear arrays, and wherein the nozzles corresponding to the other linear array of pressure generating chambers in each of said actuator units are also aligned with each other in the direction transverse to said linear arrays.

20. The ink jet print head according to claim 11 or 12, wherein the nozzles corresponding to one linear array of pressure generating chambers in one actuator unit are offset by an amount equal to P1/2 with respect to the nozzles corresponding to the other linear array of pressure generating chambers in said one actuator unit.

21. The ink jet print head to claim 11 or 12, wherein, for each actuator unit, the nozzles corresponding to one linear array of pressure generating chambers are offset by an amount equal to P1/2 with respect to the nozzles corresponding to the other linear array of pressure generating chambers.

22. The ink jet print head according to claim 21, wherein the pressure generating chambers and the corresponding nozzles in one linear array of one actuator unit are offset by an amount equal to P1/4 with respect to the pressure generating chambers and the corresponding nozzles in an adjacent linear array of an adjacent actuator unit.

23. An ink jet print head as recited in claim 7, wherein said pressure generating chambers are disposed in a single plane.

24. An ink jet print head as recited in claim 7, wherein said fluid path unit includes communicating holes that communicate respective ones of said nozzles with said pressure generating chambers.

25. An ink jet print head as recited in claim 24, wherein said communicating holes are shifted with respect to respective ones of said pressure generating chambers.

26. An ink jet print head as recited in claim 7, wherein said fluid path unit comprises an ink supply port forming substrate and a common ink chamber forming substrate, said ink supply port forming substrate including first communicating holes, said common ink chamber forming substrate including second communicating holes, said first communicating holes and said second communicating holes communicating said nozzles with said pressure chambers, said ink supply port forming substrate and said common ink chamber forming substrate being layered such that said first communicating holes and said second communicating holes are shifted with respect to respective ones of said pressure chambers.

* * * * *

UNITED STATES PATENT AND TRADEMARK OFFICE

CERTIFICATE OF CORRECTION

PATENT NO. : 6,033,058
APPLICATION NO. : 08/671556
DATED : March 7, 2000
INVENTOR(S) : Minoru Usui et al.

It is certified that error appears in the above-identified patent and that said Letters Patent is hereby corrected as shown below:

Title Page, Item (54) and Col. 1, Line 1-4
Change the title of the invention to read -- ACTUATOR FOR AN INK JET PRINT HEAD OF THE LAYERED TYPE WITH OFFSET LINEAR ARRAYS OF PRESSURE GENERATING CHAMBERS --

On the title page Item (56), under "References Cited - FOREIGN PATENT DOCUMENTS" include the following reference:

-- 0648607 4/1995 (EP) . . . . . B41J 2/14 --

Signed and Sealed this

Seventeenth Day of July, 2007

JON W. DUDAS
*Director of the United States Patent and Trademark Office*